US006103061A

United States Patent [19]

Anderson et al.

[11] Patent Number: 6,103,061

[45] Date of Patent: Aug. 15, 2000

[54] SOFT, STRONG HYDRAULICALLY ENTANGLED NONWOVEN COMPOSITE MATERIAL AND METHOD FOR MAKING THE SAME

[75] Inventors: Ralph L. Anderson, Marietta; Joseph F. Merker, Alpharetta; Fred Robert Radwanski; Henry Skoog, both of Roswell, all of Ga.

[73] Assignee: Kimberly-Clark Worldwide, Inc., Neenah, Wis.

[21] Appl. No.: 09/111,006

[22] Filed: Jul. 7, 1998

[51] Int. Cl.[7] ..... D21H 27/34

[52] U.S. Cl. ..... 162/108; 111/112; 111/115; 111/146; 111/135; 111/134

[58] Field of Search ..... 162/115, 113, 162/112, 108, 103, 135, 134, 146; 82/103, 104, 106, 107

[56] References Cited

U.S. PATENT DOCUMENTS

| | | | |
|---|---|---|---|
| 2,862,251 | 12/1958 | Kalwaites . | |
| 3,284,857 | 11/1966 | Hynek . | |
| 3,330,009 | 7/1967 | Hynek . | |
| 3,336,182 | 8/1967 | Bassett et al. . | |
| 3,486,168 | 12/1969 | Evans et al. . | |
| 3,493,462 | 2/1970 | Bunting, Jr. et al. . | |
| 3,494,821 | 2/1970 | Evans . | |
| 3,498,874 | 3/1970 | Evans et al. . | |
| 3,560,326 | 2/1971 | Bunting, Jr. et al. . | |
| 3,620,903 | 11/1971 | Bunting, Jr. et al. . | |
| 3,769,148 | 10/1973 | Barlow | 161/123 |
| 3,821,068 | 6/1974 | Shaw | 162/111 |
| 3,879,257 | 4/1975 | Gentile et al. | 162/112 |
| 4,410,579 | 10/1983 | Johns . | |
| 4,442,161 | 4/1984 | Kirayoglu et al. . | |
| 4,542,060 | 9/1985 | Yoshida et al. . | |
| 4,582,666 | 4/1986 | Kenworthy et al. . | |
| 4,755,421 | 7/1988 | Manning et al. . | |
| 4,775,579 | 10/1988 | Hagy et al. . | |
| 4,808,467 | 2/1989 | Suskind et al. . | |
| 4,879,170 | 11/1989 | Radwanski et al. . | |
| 4,931,355 | 6/1990 | Radwanski et al. . | |
| 4,939,016 | 7/1990 | Radwanski et al. . | |
| 4,950,531 | 8/1990 | Radwanski et al. . | |
| 5,026,587 | 6/1991 | Austin et al. . | |
| 5,137,600 | 8/1992 | Barnes et al. | 162/115 |
| 5,144,729 | 9/1992 | Austin et al. . | |
| 5,151,320 | 9/1992 | Homonoff et al. . | |
| 5,284,703 | 2/1994 | Everhart et al. . | |
| 5,389,202 | 2/1995 | Everhart et al. . | |
| 5,573,841 | 11/1996 | Adam et al. | 428/219 |
| 5,770,531 | 6/1998 | Sudduth et al. | 422/361 |
| 5,885,418 | 3/1999 | Anderson et al. | 162/112 |

FOREIGN PATENT DOCUMENTS

| | | |
|---|---|---|
| 841938 | 5/1970 | Canada . |
| 0159630A2 | 10/1986 | European Pat. Off. . |
| 0304825A2 | 3/1989 | European Pat. Off. . |
| 0472355A1 | 2/1992 | European Pat. Off. . |
| 90/04060 | 4/1990 | WIPO . |
| 97/03138 | 1/1997 | WIPO . |
| 97/19808 | 6/1997 | WIPO . |
| 98/44181 | 10/1998 | WIPO . |

OTHER PUBLICATIONS

"Spunlace Technology Today", Miller Freeman Publications, Inc., 1989, 2 pgs.

PCT Counterpart International Search Report mailed Feb. 15, 1999.

*Primary Examiner*—Peter Chin

*Attorney, Agent, or Firm*—Scott B. Garrison

[57] ABSTRACT

A method of making a nonwoven composite material. The method includes the steps of: providing a hydraulically entangled web containing a fibrous component and a nonwoven layer of substantially continuous filaments; applying a bonding material to at least one side of said web; and creping said at least one side of the hydraulically entangled web. The bonder material may be an aqueous mixture including a curable latex polymer, a pigment, and a cure promoter. Also disclosed is a nonwoven composite material made of a hydraulically entangled web including a fibrous component; a nonwoven layer of substantially continuous filaments; and regions containing bonder material covering at least a portion of at least one side of the composite material, wherein at least one side of the web has been creped.

32 Claims, 2 Drawing Sheets

SOFT, STRONG HYDRAULICALLY ENTANGLED NONWOVEN COMPOSITE MATERIAL AND METHOD FOR MAKING THE SAME

FIELD OF THE INVENTION

The present invention is generally directed to nonwoven composite materials. More particularly, the present invention is directed to wiping products that are strong, absorbent and soft.

BACKGROUND OF THE INVENTION

Absorbent products such as industrial wipers, food service wipers, and other similar items are designed to combine several important attributes. For example, the products should have good bulk, a soft feel and should be highly absorbent. The products should also have good strength even when wet and should resist tearing. Further, the wiping products should have good stretch characteristics, should be abrasion resistant and should not deteriorate in the environment in which they are used.

In the past, many attempts have been made to enhance and increase certain physical properties of wiping products, especially wiping products that contain a large proportion of pulp or paper. Unfortunately, however, when steps are usually taken to increase one property of a wiping product, other characteristics of the product may be adversely affected. For instance, in pulp fiber based wiping products, softness and bulk can be increased by decreasing or reducing interfiber bonding within the paper web. Inhibiting or reducing fiber bonding by chemical and/or mechanical debonding, however, adversely affects the strength of the product. A challenge encountered in designing pulp based wiping products is increasing softness, bulk and texture without decreasing strength and/or abrasion resistance.

One particular process that has proven to be very successful in producing paper towels and other wiping products is disclosed in U.S. Pat. No. 3,879,257 to Gentile, et al., which is incorporated herein by reference in its entirety. In Gentile, et al., a process is disclosed for producing soft, absorbent, single ply fibrous webs having a laminate-like structure.

The fibrous webs disclosed in Gentile, et al. are formed from an aqueous slurry of principally lignocellulosic fibers under conditions which reduce interfiber bonding. A bonding material, such as a latex elastomeric composition, is applied to a first surface of the web in a spaced-apart pattern. The bonding material provides strength to the web and abrasion resistance to the surface.

The bonding material can then be similarly applied to the opposite side of the web for further providing additional strength and abrasion resistance. Once the bonding material is applied to the second side of the web, the web can be brought into contact with a creping surface. Specifically, the web will adhere to the creping surface according to the pattern by which the bonding material was applied. The web is then creped from the creping surface with a doctor blade. Creping the web mechanically debonds and disrupts the fibers within the web, thereby increasing the softness, absorbency, and bulk of the web.

In one alternative embodiment disclosed in Gentile, et al., both sides of the paper web are creped after the bonding material has been applied.

Although this technology has been applied to paper products, it has not been tried with composites having a fibrous component and a continuous filament component that reinforces and strengthens the material. One disadvantage of the embodiments disclosed in Gentile, et al. is that the bonding material is generally cured or dried at high temperatures that degrade the continuous filaments.

Composite materials, which desirably combine pulp and a nonwoven layer of substantially continuous filaments, have desirable levels of strength but often exhibit poor tie-down of the fibrous component. That is, the fibrous material and/or any fiber rich surfaces tends to be weaker is than the continuous filament component. This can cause undesirable levels of Tinting, poor abrasion resistance and may yield a material that has less overall strength. Attempts to soften and/or increase the bulk of these composite materials can disrupt the tie-down or bonding of the fibrous material.

Thus, there currently remains a need for a pulp based wiping product that includes a continuous filament substrate. A need also exists for a pulp based wiping product incorporating a continuous filament substrate and having improved softness over conventional products while still remaining strong. A need further exists for a pulp based wiping product incorporating a continuous filament substrate that does not become compressed when wet and has the tactile aesthetics of a textile during use.

SUMMARY OF THE INVENTION

The deficiencies described above are addressed by the present invention which provides a method for forming a softened hydraulically entangled nonwoven composite material. The method includes the steps: providing a hydraulically entangled web containing a fibrous component and a nonwoven layer of substantially continuous filaments; applying a bonding material to at least one side of the web; and creping said at least one side of the hydraulically entangled web.

The bonding material may be a conventional adhesive such as, for example, an acrylate, a vinyl acetate, a vinyl chloride, or a methacrylate type adhesive.

The bonding material may contain an aqueous mixture including a curable latex polymer, a pigment, and a cure promoter. Desirably, the aqueous mixture includes about 100 dry parts by weight of curable latex polymer, between about 0.5 and 33 dry parts by weight of pigment, and between about 1 and 10 dry parts by weight of cure promoter. Even more desirably, the aqueous mixture includes about 100 dry parts by weight of curable latex polymer, between about 1 and 5 dry parts by weight of pigment, and between about 1 and 5 dry parts by weight of cure promoter.

The aqueous mixture may have a pre-cure pH adjusted to above 8 using a fugitive alkali and the mixture may be cured at a temperature below the melting temperature of any individual component of the hydraulically entangled web.

The curable latex polymer in the aqueous mixture may be cured prior to the creping step. Alternatively and/or additionally, the curable latex polynmer in the aqueous mixture may be cured after the creping step.

The bonding material may be applied to a first side of the web and to a second and opposite side of the web. The bonding material may be applied to at least one side of said web in an amount from about 2% to about 15% by weight. It is contemplated that less than about 2% (e.g., about 1%) of the bonding material may be applied to each side of the web.

The web may further contain a debonding agent, the debonding agent inhibiting at least a portion of the fibrous component of the web from bonding together. A friction reducing agent may be applied to at least one side of the web.

The bonding material can be applied to the web in a pattern. For example, the pattern may be a grid-like pattern, a fish-scale pattern, discrete points or dots, or the like. A very wide variety of patterns are contemplated.

The present invention encompasses a method for forming a composite nonwoven material which includes the steps of: (1) providing a hydraulically entangled web including a fibrous component and a nonwoven layer of substantially continuous filaments, the web having a first side and a second side; (2) applying a bonding material to the first side of the web in a preselected pattern; the bonding material being added to the first side in an amount from about 2% to about 15% by weight of said web, the bonding material being used to adhere said first side of said web to a first creping surface; (3) creping said first side of the web from the first creping surface; (4) applying said bonding agent to the second side of the web in a preselected pattern, the bonding agent being added to the second side in an amount from about 2% to about 15% by weight of the web, the bonding material being used to adhere the second side of the web to a second creping surface; and (5) creping said second side of the web from the second creping surface.

The present invention also encompasses a softened hydraulically entangled composite material made according to the process described above. The composite material contains a hydraulically entangled web that includes a fibrous component and a nonwoven layer of substantially continuous filaments; and regions containing bonding material covering at least a portion of at least one side of the composite material. Desirably, the hydraulically entangled web includes more than about 50 percent, by weight, of a fibrous component, and more than about 0 up to about 50 percent, by weight, of a nonwoven layer of substantially continuous filaments. More desirably, the hydraulically entangled web includes more than about 70 percent, by weight, of a fibrous component, and more than about 0 up to about 30 percent, by weight, of a nonwoven layer of substantially continuous filaments.

The substantially continuous filaments may be monocomponent filaments or they may be conjugate spun filaments having at least one low-softening point component and at least one high-softening point component and having at least some exterior surfaces of the filaments composed of at least one low-softening point component. Alternatively and/or additionally, the conjugate spun filaments may be splittable fibers (i.e., fibers that may be divided into a plurality of fibers or fibrils).

The fibrous component may be pulp. The fibrous component may further include synthetic fibers. The nonwoven composite material may further includes a secondary material. The secondary material may be any suitable materials such as, for example, clays, fillers, starches, particulates, superabsorbent particulates and combinations of one or more thereof.

The nonwoven composite material may have a basis weight of from about 20 to about 200 grams per square meter.

In an aspect of the invention, the softened hydraulically entangled nonwoven composite material incorporates a bonding material that may retain a colorfastness above 3 when exposed to liquids with a pH between about 2 and about 13. The composite material may incorporate a bonding material that retains a colorfastness above 3 when exposed to sodium hypochlorite. The composite material may incorporate a binder material that retains a colorfastness above 3 when exposed to alcohol.

The present invention encompasses a softened hydraulically entangled nonwoven composite material that includes: (1) a hydraulically entangled web containing a fibrous component; and a nonwoven layer of substantially continuous filaments; and (2) regions containing bonding material covering at least a portion of at least one side of the composite material, wherein at least one side of the web has been creped.

The present invention further encompasses a wiping product formed from the nonwoven composite material described above.

Definitions

As used herein the term "nonwoven fabric or web" means a web having a structure of individual fibers or threads which are interlaid, but not in an identifiable manner as in a knitted fabric. Nonwoven fabrics or webs have been formed from many processes such as for example, meltblowing processes, spunbonding processes, and bonded carded web processes. The basis weight of nonwoven fabrics is usually expressed in ounces of material per square yard (osy) or grams per square meter (gsm) and the fiber diameters useful are usually expressed in microns. (Note that to convert from osy to gsm, multiply osy by 33.91).

As used herein the term "microfibers" means small diameter fibers having an average diameter not greater than about 75 microns, for example, having an average diameter of from about 0.5 microns to about 50 microns, or more particularly, microfibers may have an average diameter of from about 2 microns to about 40 microns. Another frequently used expression of fiber diameter is denier, which is defined as grams per 9000 meters of a fiber. For example, the diameter of a polypropylene fiber given in microns may be converted to denier by squaring, and multiplying the result by 0.00629, thus, a 15 micron polypropylene fiber has a denier of about 1.42 ($15^2 \times 0.00629 = 1.415$).

As used herein the term "meltblown fibers" means fibers formed by extruding a molten thermoplastic material through a plurality of fine, usually circular, die capillaries as molten threads or filaments into converging high velocity gas (e.g. air) streams which attenuate the filaments of molten thermoplastic material to reduce their diameter, which may be to microfiber diameter. Thereafter, the meltblown fibers are carried by the high velocity gas stream and are deposited on a collecting surface to form a web of randomly disbursed meltblown fibers. Such a process is disclosed, for example, in U.S. Pat. No. 3,849,241. Generally speaking, meltblown fibers may be microfibers which may be continuous or discontinuous, are generally smaller than 10 microns in diameter, and are generally tacky when deposited onto a collecting surface.

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configuration of the material. These configurations include, but are not limited to isotactic, syndiotactic and random symmetries.

As used herein the term "monocomponent" fiber refers to a fiber formed from one or more extruders using only one polymer. This is not meant to exclude fibers formed from one polymer to which small amounts of additives have been added for coloration, anti-static properties, lubrication, hydrophilicity, etc. These additives, e.g. titanium dioxide for coloration, are generally present in an amount less than 5 weight percent and more typically about 2 weight percent.

As used herein, the term "spunbonded filaments" refers to small diameter substantially continuous filaments which are formed by extruding a molten thermoplastic material as filaments from a plurality of fine, usually circular, capillaries of a spinnerette with the diameter of the extruded filaments then being rapidly reduced as by, for example, eductive drawing and/or other well-known spun-bonding mechanisms. The production of spun-bonded nonwoven webs is illustrated in patents such as, for example, in U.S. Pat. No. 4,340,563 to Appel et al., and U.S. Pat. No. 3,692,618 to Dorschner et al., U.S. Pat. No. 3,802,817 to Matsuki et al., U.S. Pat. Nos. 3,338,992 and 3,341,394 to Kinney, U.S. Pat. No. 3,502,763 to Hartman, U.S. Pat. No. 3,502,538 to Levy, and U.S. Pat. No. 3,542,615 to Dobo et al. Spunbond filaments are generally not tacky when they are deposited onto a collecting surface. Spunbond filaments are often have diameters larger than 7 microns, more particularly, between about 10 and 20 microns.

As used herein, the term "conjugate spun filaments" refers to spun filaments and/or fibers composed of multiple filamentary or fibril elements. Exemplary conjugate filaments may have a sheath/core configuration (i.e., a core portion substantially or completely enveloped by one or more sheaths) and/or side-by-side strands (i.e., filaments) configuration (i.e., multiple filaments/fibers attached along a common interface). Generally speaking, the different elements making up the conjugate filament (e.g., the ore portion, the sheath portion, and/or the side-by-side filaments) are formed of different polymers and spun using processes such as, for example, melt-spinning processes, solvent spinning processes and the like. Desirably, the conjugate spun filaments are formed from at least two thermoplastic polymers extruded from separate extruders but spun together to form one fiber. Conjugate filaments are also sometimes referred to as multicomponent or bicomponent filaments or fibers. The polymers are usually different from each other though conjugate filaments may be monocomponent filaments. Conjugate filaments are taught in U.S. Pat. No. 5,108,820 to Kaneko et al., U.S. Pat. No. 5,336,552 to Strack et al., and U.S. Pat. No. 5,382,400 to Pike et al. For two component filaments, the polymers may be present in ratios of 75/25, 50/50, 25/75 or any other desired ratios. Alternatively and/or additionally, the conjugate spun filaments may be splittable fibers (i.e., fibers that may be divided or separated into a plurality of fibers or fibrils). Such filaments or fibers are taught in U.S. Pat. No. 4,369,156 to Mathes et al. and U.S. Pat. No. 4,460,649 to Park et al.

As used herein, the term "softening point" refers to a temperature near the melt transition of a generally thermoplastic polymer. The softening point occurs at a temperature near or just below the melt transition and corresponds to a magnitude of phase change and/or change in polymer structure sufficient to permit relatively durable fusing or bonding of the polymer with other materials such as, for example, cellulosic fibers and/or particulates. Generally speaking, internal molecular arrangements in a polymer tend to be relatively fixed at temperatures below the softening point. Under such conditions, many polymers are difficult to soften so they creep, flow and/or otherwise distort to integrate or merge and ultimately fuse or bond with other materials. At about the softening point, the polymer's ability to flow is enhanced so that it can be durably bonded with other materials. Generally speaking, the softening point of a generally thermoplastic polymer can be characterized as near or about the Vicat Softening Temperature as determined essentially in accordance with ASTM D 1525-91. That is, the softening point is generally less than about the polymer's melt transition and generally about or greater than the polymer's Vicat Softening Temperature.

As used herein, the term "low-softening point component" refers to one or more thermoplastic polymers composing an element of a conjugate spun filament (i.e., a sheath, core and/or side-by-side element) that has a lower softening point than the one or more polymers composing at least one different element of the same conjugate spun filament (i.e., high-softening point component) so that the low-softening point component may be substantially softened, malleable or easily distorted when at or about its softening point while the one or more polymers composing the at least one different element of the same conjugate spun filament remains relatively difficult to distort or reshape at the same conditions. For example, the low-softening point component may have a softening point that is at least about 20° C. lower than the high-softening point component.

As used herein, the term "high-softening point component" refers to one or more polymers composing an element of a conjugate spun filament (i.e., a sheath, core and/or side-by-side) that has a higher softening point than the one or more polymers composing at least one different element of the same conjugate spun filament (i.e., low-softening point component) so that the high-softening point component remains relatively undistortable or unshapeable when it is at a temperature under which the one or more polymers composing at least one different element of the same conjugate spun filament (i.e., the low-softening point component) are substantially softened or malleable (i.e., at about their softening point). For example, the high-softening point component may have a softening point that is at least about 20° C. higher than the low-softening point component.

As used herein the term "biconstituent filaments" refers to filaments or fibers which have been formed from at least two polymers extruded from the same extruder as a blend. The term "blend" is defined below. Biconstituent filaments do not have the various polymer components arranged in relatively constantly positioned distinct zones across the cross-sectional area of the filament and the various polymers are usually not continuous along the entire length of the filament, instead usually forming fibrils or protofibrils which start and end at random. Biconstituent filaments are sometimes also referred to as multiconstituent filaments. Fibers/filaments of this general type are discussed in, for example, U.S. Pat. No. 5,108,827 to Gessner. Conjugate and biconstituent fibers/filaments are also discussed in the textbook *Polymer Blends and Composites* by John A. Manson and Leslie H. Sperling, copyright 1976 by Plenum Press, a division of Plenum Publishing Corporation of New York, IBSN 0-306-30831-2, at pages 273 through 277.

As used herein the term "blend" means a mixture of two or more polymers while the term "alloy" means a sub-class of blends wherein the components are immiscible but have been compatibilized. "Miscibility" and "immiscibility" are defined as blends having negative and positive values, respectively, for the free energy of mixing. Further, "compatibilization" is defined as the process of modifying the interfacial properties of an immiscible polymer blend in order to make an alloy.

As used herein "thermal point bonding" refers to a bonding technique that involves passing a fabric or web of fibers to be bonded between a heated calender roll and an anvil roll. The calender roll is usually, though not always, patterned in some way so that the entire fabric is not bonded across its entire surface. As a result, various patterns for calender rolls have been developed for functional as well as aesthetic reasons. One example of a pattern has points and is the Hansen Pennings or "H&P" pattern with about a 30% bond area with about 200 bonds/square inch as taught in U.S. Pat. No. 3,855,046 to Hansen and Pennings. The H&P pattern has square point or pin bonding areas wherein each pin has a side dimension of 0.038 inches (0.965 mm), a spacing of 0.070 inches (1.778 mm) between pins, and a depth of bonding of 0.023 inches (0.584 mm). The resulting pattern has a bonded area of about 29.5%. Another typical point bonding pattern is the expanded Hansen and Pennings or "EHP" bond pattern which produces a 15% bond area with a square pin having a side dimension of 0.037 inches (0.94 mm), a pin spacing of 0.097 inches (2.464 mm) and a depth of 0.039 inches (0.991 mm). Another typical point bonding pattern designated "714" has square pin bonding areas wherein each pin has a side dimension of 0.023 inches, a spacing of 0.062 inches (1.575 mm) between pins, and a depth of bonding of 0.033 inches (0.838 mm). The resulting pattern has a bonded area of about 15%. Yet another common pattern is the C-Star pattern which has a bond area of about 16.9%. The C-Star pattern has a cross-directional bar or "corduroy" design interrupted by shooting stars. Other common patterns include a diamond pattern with repeating and slightly offset diamonds and a wire weave pattern looking as the name suggests, e.g. like a window screen. Typically, the percent bonding area varies from around 10% to around 30% of the area of the fabric laminate web. The spot bonding holds the laminate layers together as well as imparts integrity to each individual layer by bonding filaments and/or fibers within each layer.

As used herein, the term "food service wiper" means a wiper used primarily in the food service industry, i.e., restaurants, cafeterias, bars, catering, etc. but which may be used in the home as well. Food service wipers may be made from woven and/or nonwoven fabrics. These wipers are usually used to wipe up food spills on countertops, chairs, etc., and in cleanup of grease, oil, etc., from splatters or spills in the cooking or serving areas, with a variety of cleaning solutions. Cleaning solutions typically used in food service area clean up can vary widely in pH from highly acidic to highly alkaline and may be solvent solutions as well.

The term "pulp" as used herein refers to fibers from natural sources such as woody and non-woody plants. Woody plants include, for example, deciduous and coniferous trees. Non-woody plants include, for example, cotton, flax, esparto grass, milkweed, straw, jute hemp, and bagasse.

The term "average fiber length" as used herein refers to a weighted average length of pulp fibers determined utilizing a Kajaani fiber analyzer model No. FS-100 or 200 available from Kajaani Oy Electronics, Kajaani, Finland. According to the test procedure, a pulp sample is treated with a macerating liquid to ensure that no fiber bundles or shives are present. Each pulp sample is disintegrated into hot water and diluted to an approximately 0.001% solution. Individual test samples are drawn in approximately 50 to 100 ml portions from the dilute solution when tested using the standard Kajaani fiber analysis test procedure. The weighted average fiber length may be expressed by the following equation:

$$\sum_{x_i=0}^{k} (x_i * n_i)/n$$

where k=maximum fiber length $x_i$=fiber length $n_i$=number of fibers having length $x_i$ n=total number of fibers measured.

The term "low-average fiber length pulp" as used herein refers to pulp that contains a significant amount of short fibers and non-fiber particles. Many secondary wood fiber pulps may be considered low average fiber length pulps; however, the quality of the secondary wood fiber pulp will depend on the quality of the recycled fibers and the type and amount of previous processing. Low-average fiber length pulps may have an average fiber length of less than about 1.2 mm as determined by an optical fiber analyzer such as, for example, a Kajaani fiber analyzer model No. FS-100 (Kajaani Oy Electronics, Kajaani, Finland) . For example, low average fiber length pulps may have an average fiber length ranging from about 0.7 to 1.2 mm. Exemplary low average fiber length pulps include virgin hardwood pulp, and secondary fiber pulp from sources such as, for example, office waste, newsprint, and paperboard scrap.

The term "high-average fiber length pulp" as used herein refers to pulp that contains a relatively small amount of short fibers and non-fiber particles. High-average fiber length pulp is typically formed from certain non-secondary (i.e., virgin) fibers. Secondary fiber pulp which has been screened may also have a high-average fiber length. High-average fiber length pulps typically have an average fiber length of greater than about 1.5 mm as determined by an optical fiber analyzer such as, for example, a Kajaani fiber analyzer model No. FS-100 (Kajaani Oy Electronics, Kajaani, Finland). For example, a high-average fiber length pulp may have an average fiber length from about 1.5 mm to about 6 mm. Exemplary high-average fiber length pulps which are wood fiber pulps include, for example, bleached and unbleached virgin softwood fiber pulps.

As used herein, the term "colorfastness" refers to the transfer of a colored material from a sample as determined by a colorfastness to crocking test. Colorfastness to crocking is measured by placing a 5 inch by 7 inch (127 mm by 178 mm) piece of the material to be tested into a Crockmeter model cm-1 available from the Atlas Electric Device Company of 4114 Ravenswood Ave., Chicago, Ill. 60613. The crockmeter strokes or rubs a cotton cloth back and forth across the sample a predetermined number of times (in the tests herein the number was 30) with a fixed amount of force. The color transferred from the sample onto the cotton is then compared to a scale wherein 5 indicates no color on the cotton and 1 indicates a large amount of color on the cotton. A higher number indicates a relatively more colorfast sample. The comparison scale is available from the American Association of Textile Chemists and Colorists (AATCC), PO Box 12215, Research Triangle Park, N.C. 27709. This test is similar to the AATCC Test Method 8 except the AATCC test procedure uses only 10 strokes across the cloth and uses a different sample size. The inventors believe their 30 stroke method is more rigorous than the AATCC 10 stroke method.

DETAILED DESCRIPTION

It has been discovered that hydraulically entangled composite materials having good absorbing properties but are generally stiff, thin and flat (i.e., lacking texture) may be improved by printing a binding material on at least one side of the composite and compacting the web to impart texture.

Also of significance, it has been further unexpectedly discovered that the process of the present invention not only increases softness but also does not adversely affect the strength of the web in comparison to similarly made composite materials. In some applications, the strength of the web is actually increased. It has also been found that the fiber tie-down may be improved. This phenomena can result in greater abrasion resistance and lower lint values. Better fiber tie down also helps the performance of the composite fabric when subjected to mechanical softening such as creping by keeping the fibrous material joined to the continuous filament component.

Figure 1:
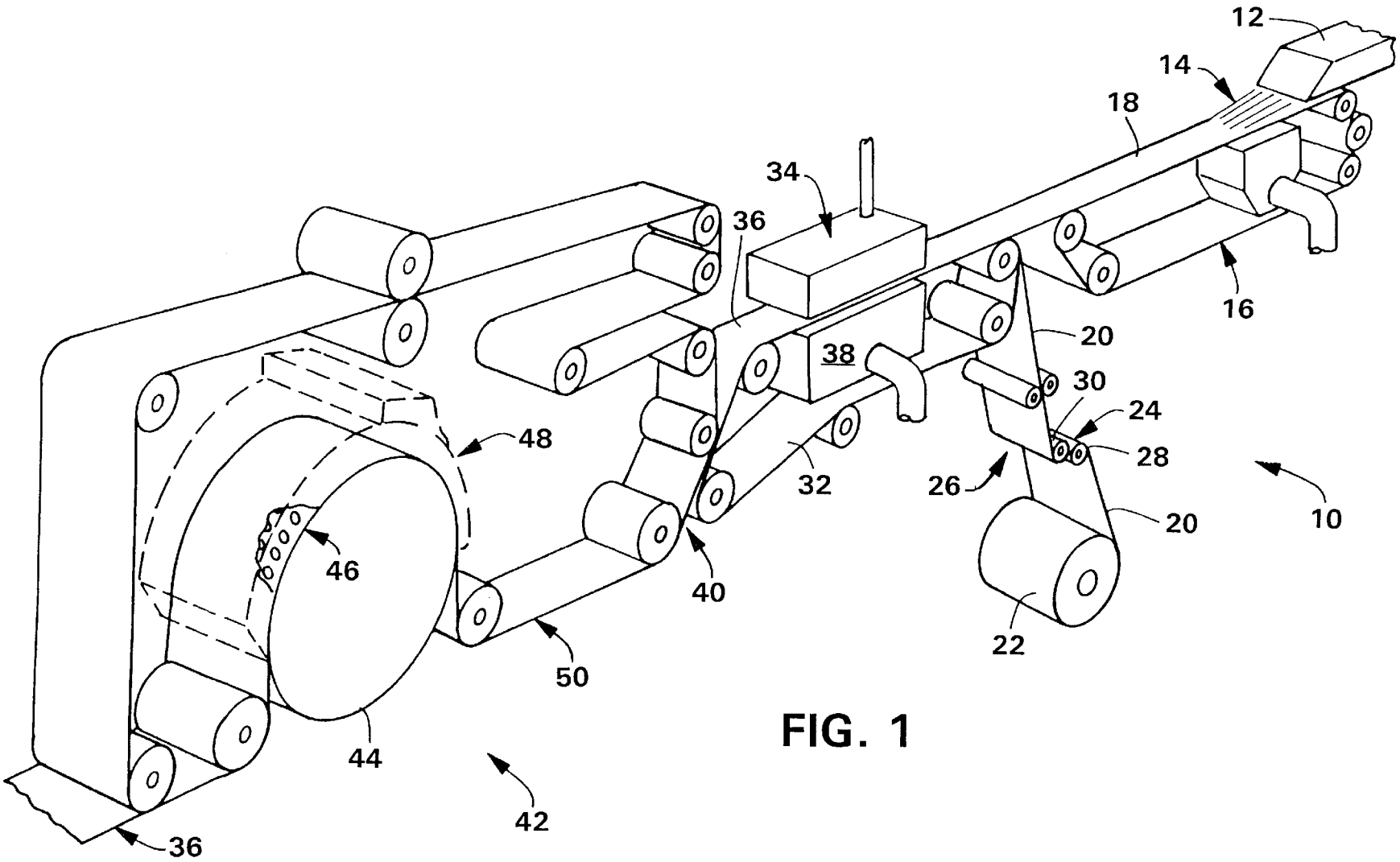
FIG. 1 is an illustration of an exemplary embodiment of a process for forming a hydraulically entangled web.

Referring now to FIG. 1, there is shown an exemplary hydraulic entangling process used to make composite materials. Hydraulically entangled composites materials containing, for example, a fibrous component such as pulp and a nonwoven layer of substantially continuous filaments are described at, for example, U.S. Pat. No. 5,389,202 to Everhart, et al., which is incorporated herein by reference in its entirety.

Generally speaking, suitable hydraulically entangled composite materials may be made by supplying a dilute suspension of pulp to a head-box 12 and depositing it via a sluice 14 in a uniform dispersion onto a forming fabric 16 of a conventional papermaking machine. The suspension of pulp fibers may be diluted to any consistency which is typically used in conventional papermaking processes. Water is removed from the suspension of pulp fibers to form a uniform layer of pulp fibers 18.

The pulp fibers may be any high-average fiber length pulp, low-average fiber length pulp, or mixtures of the same. Exemplary high-average fiber length wood pulps include those available from the Kimberly-Clark Corporation under the trade designations Longlac 19, Coosa River 56, and Coosa River 57.

The low-average fiber length pulp may be, for example, certain virgin hardwood pulps and secondary (i.e. recycled) fiber pulp from sources such as, for example, newsprint, reclaimed paperboard, and office waste.

Mixtures of high-average fiber length and low-average fiber length pulps may contain a significant proportion of low-average fiber length pulps. Other fibrous materials, such as, for example, synthetic fibers, staple length fibers, and the like may be added to the pulp fibers.

These other fibrous materials may be "non-bonding fibers" which generally refers to fibers that do not undergo hydrogen bonding during formation of the web. Non-bonding fibers can include, for instance, polyolefin fibers, polyester fibers, nylon fibers, polyvinyl acetate fibers, and mixtures thereof. The non-bonding fibers can be added to the web in an amount from about 5% to about 30% by weight. Fibrous material such as, for example, meltblown fibers may also be used. The meltblown fibrous material may be in the form of individualized fibers or a web of meltblown fibers. In one embodiment of the invention, the meltblown fibrous material may be sandwiched between two or more nonwoven layers of substantially continuous filaments. Various combinations of meltblown fibers, staple fibers, pulp and/or substantially continuous filaments are contemplated.

Besides non-bonding fibers, thermomechanical pulp can also be added. Thermomechanical pulp refers to pulp that is not cooked during the pulping process to the same extent as conventional pulps. Thermomechanical pulp tends to contain stiff fibers and has higher levels of lignin. Thermomechanical pulp can be added to the base web of the present invention in order to create an open pore structure, thus increasing bulk and absorbency.

When present, the thermomechanical pulp can be added to the base web in an amount from about 10% to about 30% by weight. When using thermomechanical pulp, a wetting agent is also preferably added during formation of the web. The wetting agent can be added in an amount less than about 1% and, in one embodiment, can be a sulphonated glycol.

Small amounts of wet-strength resins and/or resin binders may be added to improve strength and abrasion resistance. Cross-linking agents and/or hydrating agents may also be added to the pulp mixture. Debonding agents may be added to the pulp mixture to reduce the degree of hydrogen bonding if a very open or loose nonwoven pulp fiber web is desired. The addition of certain debonding agents in the amount of, for example, 1 to 4 percent, by weight, of the composite also appears to reduce the measured static and dynamic coefficients of friction and improve the abrasion resistance of the continuous filament rich side of the composite fabric. The de-bonder is believed to act as a lubricant or friction reducer.

A continuous filament nonwoven substrate 20 is unwound from a supply roll 22 and travels in the direction indicated by the arrow associated therewith as the supply roll 22 rotates in the direction of the arrows associated therewith. The nonwoven substrate 18 passes through a nip 24 of a S-roll arrangement 26 formed by the stack rollers 28 and 30.

The nonwoven substrate 20 may be formed by known continuous filament nonwoven extrusion processes, such as, for example, known solvent spinning or melt-spinning processes, and passed directly through the nip without first being stored on a supply roll. Desirably, the continuous filament nonwoven substrate is a nonwoven web of conjugate spun filaments. More desirably, the conjugate spun filaments are conjugate melt-spun filaments such as, for example, conjugate spunbond filaments. Such filaments may be shaped filaments, sheath/core filaments, side-by-side filaments or the like. The conjugate melt-spun filaments may be splittable filaments.

The spunbond filaments may be formed from any melt-spinnable polymer, co-polymers or blends thereof. Desirably, the conjugate spun filaments are conjugate melt-spun filaments. More desirably, the conjugate spun filaments are conjugate melt-spun filaments composed of at least one low-softening point component and at least one high-softening point component (in which at least some of the exterior surfaces of the filaments are composed of at least one low-softening point component). One polymeric component of the conjugate melt-spun filaments should be a polymer characterized as a low-softening point thermoplastic material (e.g., one or more low-softening point polyolefins, low-softening point elastomeric block copolymers, low-softening point copolymers of ethylene and at least one vinyl monomer [such as, for example, vinyl acetates, unsaturated aliphatic monocarboxylic acids, and esters of such monocarboxylic acids] and blends of the same). For example, polyethylene may be used as a low-softening point thermoplastic material.

Another polymeric component of the conjugate melt-spun filaments should be a polymer characterized as a high-softening point material. (e.g., one or more polyesters, polyamides, high-softening point polyolefins, and blends of the same). For example, polypropylene may be used as a high-softening point thermoplastic material.

In one embodiment of the invention, the nonwoven continuous filament substrate may have a total bond area of less than about 30 percent and a uniform bond density greater than about 100 bonds per square inch. For example, the nonwoven continuous filament substrate may have a total bond area from about 2 to about 30 percent (as determined by conventional optical microscopic methods) and a bond density from about 250 to about 500 pin bonds per square inch.

Such a combination total bond area and bond density may be achieved by bonding the continuous filament substrate with a pin bond pattern having more than about 100 pin bonds per square inch which provides a total bond surface area less than about 30 percent when fully contacting a smooth anvil roll. Desirably, the bond pattern may have a pin bond density from about 250 to about 350 pin bonds per square inch and a total bond surface area from about 10 percent to about 25 percent when contacting a smooth anvil roll.

Although pin bonding produced by thermal bond rolls is described above, embodiments of the present invention contemplate any form of bonding which produces good tie down of the filaments with minimum overall bond area. For example, ultrasonic bonding, thermal bonding, a combination of thermal bonding, ultrasonic bonding and/or latex impregnation may be used to provide desirable filament tie down with minimum bond area. Alternatively and/or additionally, a resin, latex or adhesive may be applied to the nonwoven continuous filament web by, for example, spraying or printing, and dried to provide the desired bonding. If splittable filaments/fibers are used, hydraulic entangling may be used to provide the desired level of bonding alone or in combination with other bonding techniques.

When conjugate spun filaments are used to form the nonwoven substrate 20 or are included in the nonwoven substrate 20, the nonwoven substrate may be relatively lightly bonded or even unbonded prior to entanglement with the pulp layer.

The pulp fiber layer 18 is then laid on the nonwoven substrate 20 which rests upon a foraminous entangling surface 32 of a conventional hydraulic entangling machine. It is preferable that the pulp layer 18 is between the nonwoven substrate 20 and the hydraulic entangling manifolds 34. The pulp fiber layer 18 and nonwoven substrate 20 pass under one or more hydraulic entangling manifolds 34 and are treated with jets of fluid to entangle the pulp fibers with the filaments of the continuous filament nonwoven substrate 20. The jets of fluid also drive pulp fibers into and through the nonwoven substrate 20 to form the composite material 36.

Alternatively, hydraulic entangling may take place while the pulp fiber layer 18 and nonwoven substrate 20 are on the same foraminous screen (i.e., mesh fabric) which the wet-laying took place. The present invention also contemplates superposing a dried pulp sheet on a continuous filament nonwoven substrate, rehydrating the dried pulp sheet to a specified consistency and then subjecting the rehydrated pulp sheet to hydraulic entangling.

The hydraulic entangling may take place while the pulp fiber layer 18 is highly saturated with water. For example, the pulp fiber layer 18 may contain up to about 90 percent by weight water just before hydraulic entangling. Alternatively, the pulp fiber layer may be an air-laid or dry-laid layer of pulp fibers.

The hydraulic entangling may be accomplished utilizing conventional hydraulic entangling equipment such as may be found in, for example, in U.S. Pat. No. 3,485,706 to Evans, the disclosure of which is hereby incorporated by reference. The hydraulic entangling of the present invention may be carried out with any appropriate working fluid such as, for example, water.

The fluid impacts the pulp fiber layer 18 and the nonwoven substrate 20 which are supported by a foraminous surface which may be, for example, a single plane mesh having a mesh size of from about 8 ×8 to about 100×100. The foraminous surface may also be a multi-ply mesh having a mesh size from about 50×50 to about 200×200.

The wire mesh pattern may be selected to provide a textile-like appearance on the hydraulically entangled product. For example, coarse mesh fabrics tend to produce noticeable ridges and valleys on the hydraulically entangled fabric. One desirable mesh material may be obtained from Albany International of Portland, Tennessee under the designation FormTech 14 Wire. The wire may be described as a 14-C Flat Warp 14×13 mesh, single layer weave. The warp strands are 0.88×0.57 mm polyester. The shute strands are 0.89 mm polyester. The average caliper is 0.057 inch, Air Permeability 725 cfm (cubic feet per minute); and the open area is 27.8 percent.

As is typical in many water jet treatment processes, vacuum slots 38 may be located directly beneath the hydroneedling manifolds or beneath the foraminous entangling surface 32 downstream of the entangling manifold so that excess water is withdrawn from the hydraulically entangled composite material 36.

After the fluid jet treatment, the composite fabric 36 may be transferred to a non-compressive drying operation. A differential speed pickup roll 40 may be used to transfer the material from the hydraulic needling belt to a non-compressive drying operation. Alternatively, conventional vacuum-type pickups and transfer fabrics may be used. If desired, the composite fabric may be wet-creped before being transferred to the drying operation. Non-compressive drying of the web may be accomplished utilizing a conventional rotary drum through-air drying apparatus shown in FIG. 1 at 42. The through-dryer 42 may be an outer rotatable cylinder 44 with perforations 46 in combination with an outer hood 48 for receiving hot air blown through the perforations 46. A through-dryer belt 50 carries the composite fabric 36 over the upper portion of the through-dryer outer cylinder 40. The heated air forced through the perforations 46 in the outer cylinder 44 of the through-dryer 42 removes water from the composite fabric 36. Other useful through-drying methods and apparatus may be found in, for example, U.S. Pat. Nos. 2,666,369 and 3,821,068, the contents of which are incorporated herein by reference. It should be understood, however, that other drying devices may be used in the process. For instance, it is believed that during some applications, a Yankee dryer may be used in place of or in addition to the through-drying operation.

The fabric may contain various materials such as, for example, scouring agents, abrasives, activated charcoal, clays, starches, and superabsorbent materials. For example, these materials may be added to the suspension of pulp fibers used to form the pulp fiber layer. These materials may also be deposited on the pulp fiber layer prior to the fluid jet treatments so that they become incorporated into the composite fabric by the action of the fluid jets. Alternatively and/or additionally, these materials may be added to the composite fabric after the fluid jet treatments.

A binder material may be applied to the hydraulically entangled composite fabric 36 either prior to the drying operation or after the drying operation. The binder material may be applied utilizing any conventional technique. Desirably, the binder material is printed onto the composite material. The printing method may be any which is known in the art to be effective such as, for example, flexographic printing, gravure printing, ink jet printing, spray printing and/or screen printing.

Generally speaking, the binder material may be latex based. They may contain a latex base and a cure promoter and a, if desired, a pigment. A cure promoter may be added to a latex base in order to allow curing of the composition at ambient temperatures, well below that which would melt the polymer components of a nonwoven web which generally includes a polyolefin like polypropylene if it is considered desirable to avoid such temperatures. The curing process may be triggered by the loss of a fugitive alkali which may be made part of the formulation. Alternatively, latex polymers with internal curing agents may be used.

A viscosity modifier or additional water may also be part of the formulation if the viscosity is not in the proper range for printing after the addition of all ingredients.

An acceptable latex polymer system for use in this invention should be cross-linkable at room temperature or at slightly elevated temperatures and should be stable to ambient weather conditions and be flexible when cured. Examples include polymers of ethylene vinyl acetates, ethylene vinyl chlorides, styrene-butadiene, acrylates, and styrene-acrylate copolymers. Such latex polymers generally have a Tg in the range of −15 to +20° C. One such suitable latex polymer composition is known as HYCAR® 26084 from the B.F. Goodrich Company of Cleveland, Ohio. Other suitable latexes include HYCAR® 2671, 26445, 26322 and 26469 from B.F. Goodrich, RHOPLEX® B-15, HA-8 and NW-1715 from Rohm & Haas, DUR-O-SET® E-646 from National Starch & Chemical Co. of Bridgewater, N.J. and BUTOFAN® 4261 and STYRONAL® 4574 from BASF of Chattanooga, Tenn.

An acceptable pigment for use in this invention (if pigment is desired) must be compatible with the latex and crosslinker used. Generally speaking, pigments refer to compositions having particulate color bodies, not liquid as in a dye. Commercially available pigments for use in this invention include those manufactured by the Sandoz Chemical Company of Charlotte, N.C., under the trade designation GRAPHTOLO®. Particular pigments include GRAPHTOL® 1175-2 (red), GRAPHTOL® 6825-2 (blue), GRAPHTOL® 5869-2 (green), and GRAPHTOLO® 4534-2 (yellow). Combinations of pigments may be used to provide various colors.

In addition to or perhaps in place of some pigment, a filler such as clay may be used as an extender. The clay appears to have an effect of reducing the colorfastness of the composition and will not provide the color of a pigment of course, but it represents a cost saving measure as it is less expensive than pigments. A clay which may be used is, for example, Ultrawhite 90, available from the Englehard Corp., 101 Wood Ave, Iselin, N.J. 08830.

Useful cure promoters should cause or result in the crosslinking of the latex polymer in the composition. Desirably, the cure promoters should allow the latex based composition to cure at room temperature or slightly above so that the composite material does not need to be heated to a temperature at which it may begin to melt in order to cure the latex. The cure promoter may become active at a pH which is neutral or acidic so that the binder composition is kept at a pH of above 8 during mixing and application. The pre-cure pH is kept above 8 by the use of a fugitive alkali such as, for example, ammonia. Fugitive alkalis remain in solution until driven off by drying at room temperature or alternatively, heating them a small amount to increase the evaporation rate. The loss of the alkali causes a drop in the pH of the composition which triggers the action of the cure promoter.

Suitable cure promoters are for example, XAMAO®-2 and XAMAO®-7 and are available commercially from the B.F. Goodrich Company of Cleveland, Ohio. Another acceptable cure promoter is Chemitite PZ-33 available from the Nippon Shokubai Co. of Osaka, Japan. These materials are aziridine oligimers with at least two aziridine functional groups.

A viscosity modifier, though generally not necessary, may be used if the viscosity of the printing composition is not suitable for the method of printing desired. One such suitable viscosity modifier is known as ACRYSOLO® RM-8 and is available is from the Rohm & Haas Company of Philadelphia, Pa. If it is desired to reduce the viscosity of the printing composition of this invention, water may simply be added to the mixture.

Other suitable bonding materials that may be used in the present invention include latex compositions, such as acrylates, vinyl acetates, vinyl chlorides, and methacrylates. Other bonding materials that may also be used include polyacrylamides, polyvinyl alcohols, and carboxymethyl cellulose.

In one embodiment, the bonding material used in the process of the present invention comprises an ethylene vinyl acetate copolymer. In particular, the ethylene vinyl acetate copolymer may be cross-linked with N-methyl acrylamide groups using an acid catalyst. Suitable acid catalysts include ammonium chloride, citric acid, and maleic acid. The bonding agent should have a glass transition temperature of not lower than about −10° F. and not higher than +10° F.

As noted above, the bonding material is applied to the composite fabric 36 in a preselected pattern. In one embodiment, for instance, the binder material can be applied to the composite fabric 36 in a reticular pattern, such that the pattern is interconnected forming a net-like design on the surface. For example, the binder material can be applied according to a diamond shaped grid. The diamonds, in one embodiment, can be square having a length dimension of ⅛ inch. In an alternative embodiment, the diamonds comprising the grid can have length dimensions of $6\times10^{-3}$ inch and $9\times10^{-3}$ inch.

In another embodiment, the binder material may be applied to the fabric in a pattern that represents a succession of discrete dots. This particular embodiment may be well suited for use with lower basis weight wiping products. Applying the bonding agent in discrete shapes, such as dots, provides sufficient strength to the fabric without covering a substantial portion of the surface area of the web. In some situations, applying the binder material to the surfaces of the fabric can adversely affect the absorbency of the fabric. Thus, in some applications, it is preferable to minimize the amount of binder material applied.

In a further alternative embodiment, the binder material can be applied to the fabric/web 36 according to a reticular pattern in combination with discrete dots. For example, in one embodiment, the binder material can be applied to the fabric according to a diamond shaped grid having discrete dots applied to the web within the diamond shapes.

The binder material agent can be applied to each side of the fabric so as to cover almost any amount of surface area.

For example, the binder material may be applied to cover from about 10% to about 60% of the surface area. Desirably, the binder material will cover from about 20% to about 40% of the surface area of each side of the fabric. The total amount of binder material applied to each side of the fabric/web will preferably be in the range of from about 2% to about 15% by weight, based upon the total weight of the web. Thus, when the binder material is applied to each side of the fabric, the total add on will be from about 4% to about 30% by weight.

Figure 2:
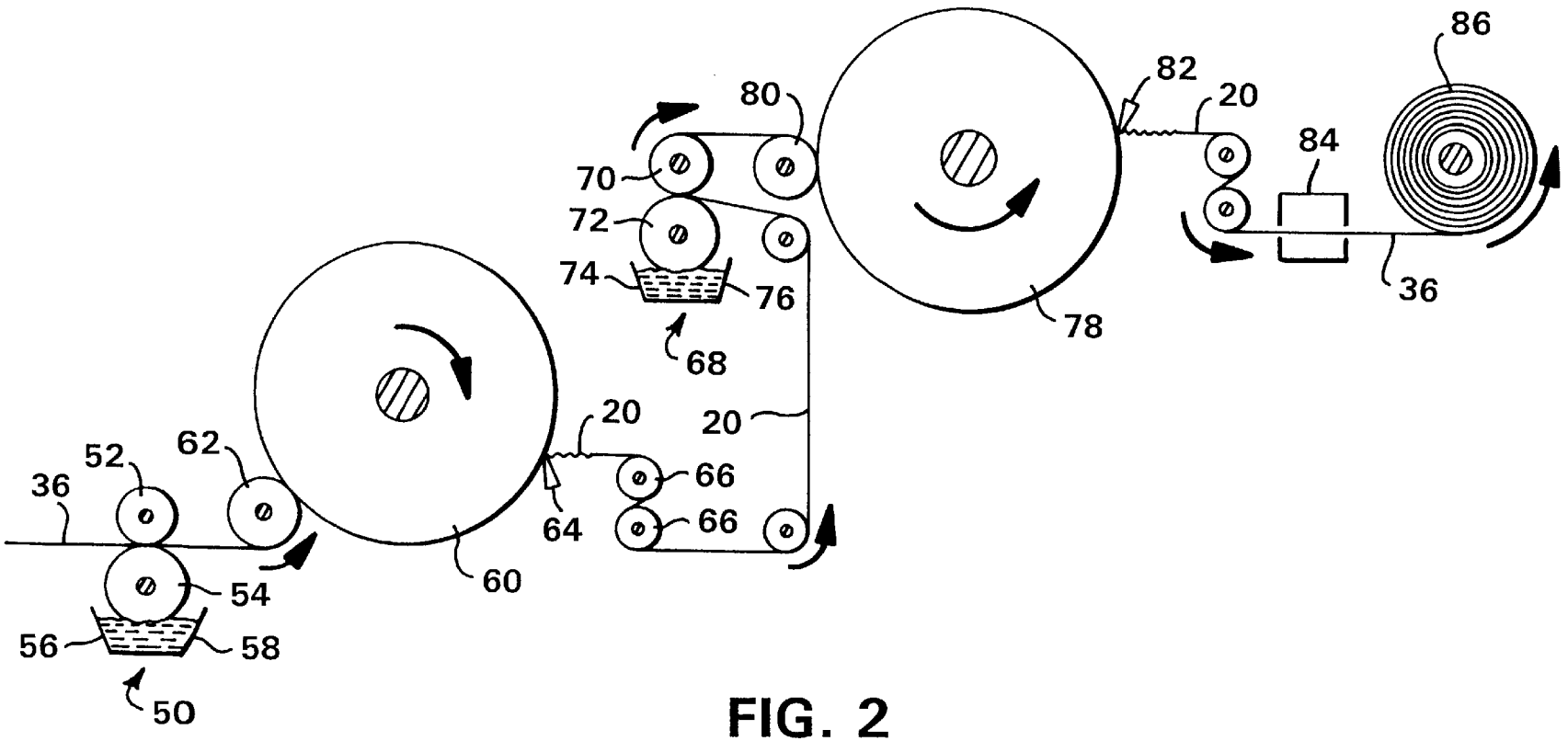
FIG. 2 is a schematic diagram of one embodiment of a process for double creping a paper web in accordance with the present invention.

Referring now to FIG. 2, there is shown an exemplary embodiment of a process in which a bonding material is applied to both sides of a web 36 and both sides of the web are creped.

A nonwoven composite fabric or web 36 made according to the process illustrated in FIG. 1 or according to a similar process, is passed through a first bonding agent application station generally 50. Station 50 includes a nip formed by a smooth rubber press roll 52 and a patterned rotogravure roll 54. Rotogravure roll 54 is in communication with a reservoir 56 containing a first bonding agent 58. Rotogravure roll 54 applies bonding agent 58 to one side of web 36 in a preselected pattern.

The web 36 is then pressed into contact with a first creping drum 60 by a press roll 62. The web adheres to creping drum 60 in those locations where the bonding agent has been applied. If desired, creping drum 60 can be heated for promoting attachment between the web and the surface of the drum and for partially drying the web. Care should be taken so the temperature of the drum is not hot enough to degrade the strength of the web.

Once adhered to creping drum 60, web 36 is brought into contact with a creping blade 64. Specifically, the web 36 is removed from creping roll 60 by the action of creping blade 64, performing a first controlled pattern crepe on the web.

Once creped, the web 36 can be advanced by pull rolls 66 to a second bonding agent application station generally 68. Station 68 includes a transfer roll 70 in contact with a rotogravure roll 72, which is in communication with a reservoir 74 containing a second bonding agent 76. Similar to station 50, second bonding agent 76 is applied to the opposite side of the web 36 in a preselected pattern. Once the second bonding agent is applied, web 20 is adhered to a second creping roll 78 by a press roll 80. The web 36 is carried on the surface of creping drum 78 for a distance and then removed therefrom by the action of a second creping blade 82. Second creping blade 82 performs a second controlled pattern creping operation on the second side of the web.

Once creped for a second time, the web 36, in this embodiment, is pulled through a curing or drying station 84. The drying station 84 can include any form of a heating unit, such as an oven energized by infrared heat, microwave energy, hot air or the like. The drying station 84 may be necessary in some applications to dry the web and/or cure the first and second bonding agents. Depending upon the bonding agents selected, however, in other applications drying station 84 may not be needed. Care should be taken so the temperature of the web at the drying station does not get high enough to degrade the strength of the web. Desirably, the bonding material is adapted to cure at low temperatures so a curing station is not required.

Once drawn through the drying station 84, the web 36 can be transferred to another location for further processing or can be cut into commercial size sheets for packaging as a cloth-like wiping product.

The bonding agents applied to each side of the web 36 are selected for not only assisting in creping the web but also for adding dry strength, wet strength, stretchability, and tear resistance to the paper. The bonding agents also prevent lint from escaping from the wiping products during use.

After the bonding material is applied to the web and the web is creped, the web is ready for use as a cloth-like wiping product in accordance with the present invention. Alternatively, however, further processing steps can be performed on the web as desired.

It is contemplated that the web 36 may be rolled up with relatively high levels of stretch imparted to the web by the creping process. This results in a web having a high level of texture which may enhance wiping, scrubbing and/or cleaning. Alternatively, much of the texture or stretch may be pulled out of the sheet by stretching or pulling the sheet. This may be done immediately after creping or it may be done during a rewinding operation or the like. Such a stretched or pulled sheet tends to have a smooth, soft appearance that provides a wiper that readily conforms to surfaces.

In one embodiment, the web can be calendered and then treated with a friction reducing agent in order to provide a resulting wiping product having a smooth, low friction surface. It should be understood, however, that calendering step can be eliminated from the process if it is important to preserve as much bulk as possible in web.

The friction reducing composition may be sprayed onto the web or it may also be printed on the web using a lithographic printing fountain. The friction reducing composition can be applied to either a single side of the web or to both sides of the web.

Once applied to web, the friction reducing composition increases the smoothness of the surface of the web and lowers friction. Some examples of friction reducing compositions that may be used in the process of the present invention are disclosed in U.S. Pat. No. 5,558,873 to Funk. et al., which is incorporated herein by reference.

In one embodiment, the friction reducing composition applied is a quaternary lotion, such as a quaternary silicone spray. For instance, the composition can include a silicone quaternary ammonium chloride. One commercially available silicone glycol quaternary ammonium chloride suitable for use in the present invention is ABIL SW marketed by Goldschmidt Chemical Company of Essen, Germany.

In another embodiment, the friction reducing composition is applied to one side of the web in an amount from about 0.4% to about 2% by weight and particularly from about 0.4% to about 1.4% by weight, based upon the weight of the web.

After being sprayed with the friction reducing composition, the web may be fed to a dryer, such as an infrared dryer, to remove any remaining moisture within the web.

The web can then be wound into a roll of material, which can be transferred to another location and cut into commercial size sheets for packaging as a wiping product.

The textured composite nonwoven materials made according to the above-described process provide many advantages and benefits over many wiping products made in the past. Of particular advantage, the wiping products of the present invention have the appearance and feel of a textile product.

In comparison to conventionally made untextured hydraulically entangled composite materials, the textured materials of the present invention have much more conformability and stretch. The textured materials may also provide better wiping or scrubbing properties because of the texture. Also, the better tie-down or bonding of the fibrous material provides greater abrasion resistance, lower levels of linting and better strength. Further, the textured composite materials of the present invention have improved wet bulk due to the texture and the latex printing.

The basis weight of softened hydraulically entangled nonwoven composite materials made according to the present invention can generally range from about 20 to about 200 grams per square meter (gsm), and particularly from about 35 gsm to about 100 gsm. In general, lower basis weight products are well suited for use as light duty wipers while the higher basis weight products are better adapted for use as industrial wipers.

The present invention may be better understood with reference to the following example.

EXAMPLE

Softened hydraulically entangled nonwoven composite materials were made from a hydraulically entangled composite material. Two different bonding materials were applied and during the creping operation. The resulting products were compared with an untreated (i.e., unprinted and uncreped) wiping product made of essentially the same hydraulically entangled composite material.

Three different wiping products were produced and tested. The results of the tests are contained in Table 1 below. The base web used to make the samples was identical and was formed by wet-depositing a paper web onto a nonwoven web of substantially continuous filaments and then through dried. The base web is available from Kimberly-Clark Corporation as Workhorses® Manufactured Rags and had a basis weight of approximately 55 gsm. The material contained about 75%, by weight, Northern Softwood Kraft pulp and about 25%, by weight, polypropylene spunbond. Results of testing this material are reported in Table 1 under the heading Sample 1.

The two creped samples were printed with a latex bonding material on both sides. In each case, the latex bonding material was applied according to a ¼ inch diamond pattern in combination with an over pattern of dots. The latex bonding materials were mixed to contain 33% latex solids and were printed at a print pressure of 30 pounds per square inch. The latex bonding material was applied to each surface of the base web in an amount of 5% by weight. The samples were creped on each side according to the procedure shown at FIG. 2 utilizing creping dryers set at 210° F., 10 degree creping blade, 18 degree shelf angle to achieve approximately a 15% crepe.

One creped sample was printed with a latex available from Air Products under the designation Airflex A-105. This sample required curing in a cure oven set at 280° F. for less than one second. Results of testing this material are reported in Table 1 under the heading Sample 2.

Another creped sample was printed with a latex available from B.F. Goodrich of Cleveland, Ohio, as HYCAR® 26469 latex. The material is a carboxylated acrylic. The latex was mixed with about 5%, by weight, of a cure promoter available from B.F. Goodrich designation XAMAO®- 17. This material is an aziridine derivative. Approximately 0.5%, by weight, of an ammonium chloride catalyst was added to the XAMAO®-7 cure promoter. A small amount of defoamer was also added. This sample required no additional curing. Results of testing this material are reported in Table 1 under the heading Sample 3.

TABLE 1

| Sample No. | 1 | 2 | 3 | 4 |
|---|---|---|---|---|
| Basis Weight (gsm) | 55.8 | 63.6 | 62 | |
| Bulk | 450 | 517 | 530 | |
| Machine Direction Tensile Strength (oz) | 122 | >160 | 155 | |
| Machine Direction Stretch (%) | 27 | — | 42 | |
| Cross-Direction Tensile Strength (oz) | 58 | 85 | 80 | |
| Cross-Direction Stretch (%) | 134 | 140 | 137 | |
| Cross-Direction Wet Tensile Strength (oz/in) | — | 69 | 75.6 | |
| Taber (cycles) | 41 | 50 | 50 | |
| Wipe Dry ($cm^2$) | — | 400 | 25 | |
| Z dir wick (g water/g fiber/sec) | — | 0.917 | 0.626 | |
| XY dir wick (g water/g fiber/sec) | — | 0.295 | 0.401 | |
| Lint (No. of particles/10 micron screen) | 318 | 80 | 79 | |
| Machine Direction Tear (lbs) | 4.7 | 4.9 | 4.9 | |
| Cross-Direction Tear (lbs) | 3.2 | 3.4 | 3.6 | |
| Total Water Capacity (g water/g product) | 4.67 | 2.95 | 3.16 | |
| Bending Modulus Machine Direction | 3.8 | 3.32 | 3.97 | |
| Bending Modulus Cross-Direction | 2.23 | 2.5 | 2.77 | |

The above tests performed on the samples were done according to conventional methods which are well known in the art. From the above table, Taber refers to an abrasion test that determines how many cycles it takes for a paper wiping product to develop a ½ inch hole. The wipe dry test above determines the area of a 1.5 mil pool of water that will be absorbed by a sheet of a paper wiping product having a particular size.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed is:

1. A method for forming a composite nonwoven material comprising the steps of:

providing a hydraulically entangled web comprising more than about 50percent, by weight, of a fibrous component comprising pulp and more than about 0 up to about 50 percent, by weight, of a nonwoven layer of substantially continuous filaments;

applying a bonding material to at least one side of said web in a preselected pattern; the bonding material being added to at least one side of said web in an amount from about 2% to about 15% by weight of said web; and creping said at least one side of the hydraulically entangled web.

2. A method as defined in claim 1, wherein said bonding material is applied to a first side of the web and to a second and opposite side of the web.

3. A method as defined in claim 2, wherein the first side of the web and the second side of the web are creped.

4. A method as defined in claim 1, wherein the bonding material comprises a material selected from the group consisting of an acrylate, a vinyl acetate, a vinyl chloride, and a methacrylate.

5. The method of claim 1, wherein the bonding material comprises an aqueous mixture including a curable latex polymer, a pigment, and a cure promoter.

6. The method of claim 5, wherein the aqueous mixture comprises about 100 dry parts by weight of curable latex polymer, between about 0.5 and 33 dry parts by weight of pigment, and between about 1 and 10 dry parts by weight of cure promoter.

7. The method of claim 5, wherein the aqueous mixture comprises about 100 dry parts by weight of curable latex polymer, between about 1 and 5 dry parts by weight of pigment, and between about 4 and 6 dry parts by weight of cure promoter.

8. The method of claim 5, wherein the aqueous mixture has a pre-cure pH adjusted to above 8 using a fugitive alkali and the mixture is cured at a temperature below the melting temperature of the hydraulically entangled web.

9. The method of claim 5, wherein the curable latex polymer in the aqueous mixture is cured after the compacting step.

10. The method of claim 1, wherein the web further contains a debonding agent, the debonding agent inhibiting at least a portion of the fibrous component of the web from bonding together.

11. The method of claim 1, further comprising the step of applying a friction reducing agent to at least,one side of the web.

12. The method of claim 1, wherein the pattern comprises a grid-like pattern.

13. A composite nonwoven material made according to the process defined in claim 1.

14. The composite material of claim 13, wherein the substantially continuous filaments are conjugate spun filaments comprising at least one low-softening point component and at least one high-softening point component and having at least some exterior surfaces of the filaments composed of at least one low-softening point component.

15. The composite material of claim 13, wherein the fibrous component further comprises synthetic fibers.

16. The composite material of claim 13, wherein the composite material further includes secondary materials.

17. The composite material of claim 16, wherein the secondary material is selected from clays, fillers, starches, particulates, superabsorbent particulates and combinations thereof.

18. The composite material of claim 13, wherein the material has a basis weight of from about 20 to about 200 grams per square meter.

19. The composite material of claim 13, wherein the bonding material retains a colorfastness above 3 when exposed to liquids with a pH between about 2 and about 13.

20. The composite material of claim 13, wherein the bonding material retains a colorfastness above 3 when exposed to sodium hypochlorite.

21. The composite material of claim 13, wherein the bonding material retains a colorfastness above 3 when exposed to alcohol.

22. A method for forming a composite nonwoven material comprising the steps of:

providing a hydraulically entangled web comprising more than about 50 percent, by weight, of a fibrous component comprising pulp and more than about 0 up to about 50 percent, by weight, of a nonwoven layer of substantially continuous filaments, the web having a first side and a second side;

applying a bonding material to the first side of the web in a preselected pattern; the bonding material being added to the first side in an amount from about 2% to about 15% by weight of said web, said bonding material being used to adhere said first side of said web to a first creping surface;

creping said first side of the web from the first creping surface;

applying said bonding agent to the second side of the web in a preselected pattern, the bonding agent being added to the second side in an amount from about 2% to about 15% by weight of the web, the bonding material being used to adhere the second side of the web to a second creping surface; and creping said second side of the web from the second creping surface.

23. A nonwoven composite material comprising:

a hydraulically entangled web comprising:

more than about 50 percent, by weight, of a fibrous component comprising pulp; and more than about 0 up to about 50 percent, by weight, of a nonwoven layer of substantially continuous filaments; and regions containing bonding material covering at least a portion of at least one side of the composite material in a preselected pattern, the bonding material being added to at least one side of said web in an amount from about 2% to about 15% by weight of said web, wherein at least one side of the web has been creped.

24. The nonwoven composite material of claim 23, wherein the hydraulically entangled web contains more than about 70 percent, by weight, of the fibrous component; and more than about 0 up to about 30 percent, by weight, of the nonwoven layer of substantially continuous filaments.

25. The nonwoven composite material of claim 23, wherein the substantially continuous filaments are conjugate spun filaments comprising at least one low-softening point component and at least one high-softening point component and having at least some exterior surfaces of the filaments composed of at least low-softening point component.

26. The nonwoven composite material of claim 23, wherein the fibrous component further comprises synthetic fibers.

27. The nonwoven composite material of claim 23, wherein the composite material further includes a secondary material.

28. The nonwoven composite material of claim 27 wherein the secondary material is selected from clays, fillers, starches, particulates, superabsorbent particulates and combinations thereof.

29. The nonwoven composite material of claim 23, wherein the material has a basis weight of from about 20 to about 200 grams per square meter.

30. A wiping product comprising the nonwoven composite material of claim 23.

31. The method of claim 1, wherein the hydraulically entangled web contains more than about 70 percent, by weight, of the fibrous component; and more than about 0 up to about 30 percent, by weight, of the nonwoven layer of substantially continuous filaments.

32. The composite material of claim 13, wherein the hydraulically entangled web contains more than about 70 percent, by weight, of the fibrous component; and more than about 0 up to about 30 percent, by weight, of the nonwoven layer of substantially continuous filaments.

* * * * *